United States Patent [19]

Songer

[11] Patent Number: 5,036,766

[45] Date of Patent: Aug. 6, 1991

[54] MOUNTING CONSTRUCTION FOR A PRINTING CYLINDER

[75] Inventor: Richard F. Songer, Ellicottville, N.Y.

[73] Assignee: Luminite Products Corporation, Salamanca, N.Y.

[21] Appl. No.: 404,558

[22] Filed: Sep. 8, 1989

[51] Int. Cl.[5] ..... B41F 13/10; B41F 13/08

[52] U.S. Cl. ..... 101/375; 29/129

[58] Field of Search ..... 101/375, 376; 29/129, 29/122, 129.5

[56] References Cited

U.S. PATENT DOCUMENTS

| | | | |
|---|---|---|---|
| 637,606 | 11/1899 | Hett | 101/375 X |
| 1,759,192 | 5/1930 | Fulk | 101/375 |
| 2,315,729 | 4/1943 | Nunnally | 101/375 |
| 2,721,601 | 10/1955 | Spencer | 154/41 |
| 2,987,994 | 6/1961 | Allison | 101/375 |
| 3,136,672 | 6/1964 | Prongay | 156/14 |
| 3,225,692 | 12/1965 | Oakes | 101/375 |
| 3,378,902 | 4/1968 | Hoexter | 29/113 |
| 3,590,452 | 7/1971 | Macleod | 101/375 X |
| 3,793,948 | 3/1974 | Hugonnier | 101/375 |
| 3,921,524 | 11/1975 | Ritchie | 101/329 |
| 4,718,154 | 1/1988 | Bauer et al. | 29/129 X |

FOREIGN PATENT DOCUMENTS

| | | | |
|---|---|---|---|
| 3410638 | 10/1985 | Fed. Rep. of Germany | 101/375 |
| 277452 | 12/1986 | Japan | 101/375 |
| 449855 | 7/1936 | United Kingdom | 101/375 |

*Primary Examiner*—Clifford D. Crowder
*Attorney, Agent, or Firm*—Joseph P. Gastel

[57] ABSTRACT

A printing cylinder comprising a hollow polyurethane cylinder having a plurality of ribs extending radially inwardly from its internal surface. A modified printing cylinder wherein the radially extending ribs are embedded in metal rings at opposite ends thereof. A printing cylinder mounting construction including a shaft, a pair of spaced hubs on the shaft, a hollow printing cylinder having a plurality of inwardly radially extending ribs, enlarged slots in one of the hubs which permits the ribs to pass over that hub, facing tapered surfaces on the hubs, mating tapered surfaces at the ends of the ribs, a rotary adjustment on the hub having the enlarged slots therein for permitting that hub to be rotated to place the inclined surfaces on the ribs and the inclined surfaces on that hub into contiguous relationship, and a screw adjustment for axially moving that hub to wedge the ribs onto the inclined surfaces of the spaced hubs. A printing cylinder mounting construction including a shaft with spaced hubs, a hollow printing cylinder having a plurality of inwardly radially extending ribs mounting in metal rings on their inner ends, slots in both of the rings, keys in one of the hubs to permit the sleeve to slide over that hub when the slots in the keys are in alignment, and the other hub being rotatable and having gibs thereon spaced from a shoulder for clamping the metal ring on that hub after the hub has been rotated out of alignment with the slots in the metal ring which is located thereon.

15 Claims, 3 Drawing Sheets

MOUNTING CONSTRUCTION FOR A PRINTING CYLINDER

BACKGROUND OF THE INVENTION

The present invention relates to improved printing cylinder constructions and mounting structures therefor.

By way of background, in the past printing cylinders for the wallpaper industry generally comprised an 1/8 inch aluminum sleeve on which an outer elastomeric sleeve was mounted. Cylinders of this type carried hub structure which required locking structure on an associated shaft to be removed when the printing cylinder was to be mounted on the shaft. This was burdensome in that changing of a printing cylinder usually took approximately 15 minutes because of the necessity for removing certain of the locking structure from the shaft, removing the printing cylinder, placing a new printing cylinder on the shaft, remounting the mounting structure and thereafter circumferentially adjusting the printing cylinder and tightening the mounting structure. When a number of printing cylinders were to be changed, this involved a down time of approximately three to four hours of the printing machinery for replacement of up to twelve cylinders and properly adjusting them.

SUMMARY OF THE INVENTION

It is the primary object of the present invention to provide improved printing cylinder mounting constructions which permit the cylinder to be mounted on an associated shaft without removing the locking structure therefor.

It is another object of the present invention to provide improved mounting structures for a printing cylinder which automatically aligns the printing cylinder incidental to its placement on the shaft.

Another object of the present invention is to provide an improved printing cylinders which do not require an aluminum sleeve liner. Other objects and attendant advantages of the present invention will readily be perceived hereafter.

The present invention relates to a printing cylinder comprising an elongated hollow plastic cylinder having an external surface and an internal surface, and a plurality of ribs extending inwardly from said internal surface and extending longitudinally of said cylinder.

The present invention also relates to a mounting construction for a printing cylinder comprising a shaft, first and second spaced hubs on said shaft, a hollow printing cylinder having an external surface and an internal surface, a plurality of circumferentially spaced ribs extending inwardly from said internal surface, coacting means on one of said hubs and on said ribs for permitting said printing cylinder to move axially over said one hub and onto the other of said hubs, and means on at least one of said two hubs for locking said printing cylinder thereto.

The present invention also relates to a mounting construction for a printing cylinder comprising a shaft, a first hub on said shaft, a second hub on said shaft axially spaced from said first hub, an elongated hollow printing cylinder having first and second internal end portions, first coacting means between said second internal end portion and said first hub for permitting said second internal end portion to pass axially over said first hub until said second internal end portion is proximate said second hub and said first internal end portion is proximate said first hub, second coacting means between one of said first and second hubs and one of said first and second internal end portions, respectively, for locking said hollow printing cylinder relative thereto, and third coacting means on the other of said first and second hubs and the other of said first and second internal end portions for mounting said hollow printing cylinder thereon.

The various aspects of the present invention will be more fully understood when the following portions of the specification are read in conjunction with the accompanying drawings wherein:

DESCRIPTION OF THE PREFERRED EMBODIMENTS

Figure 1:
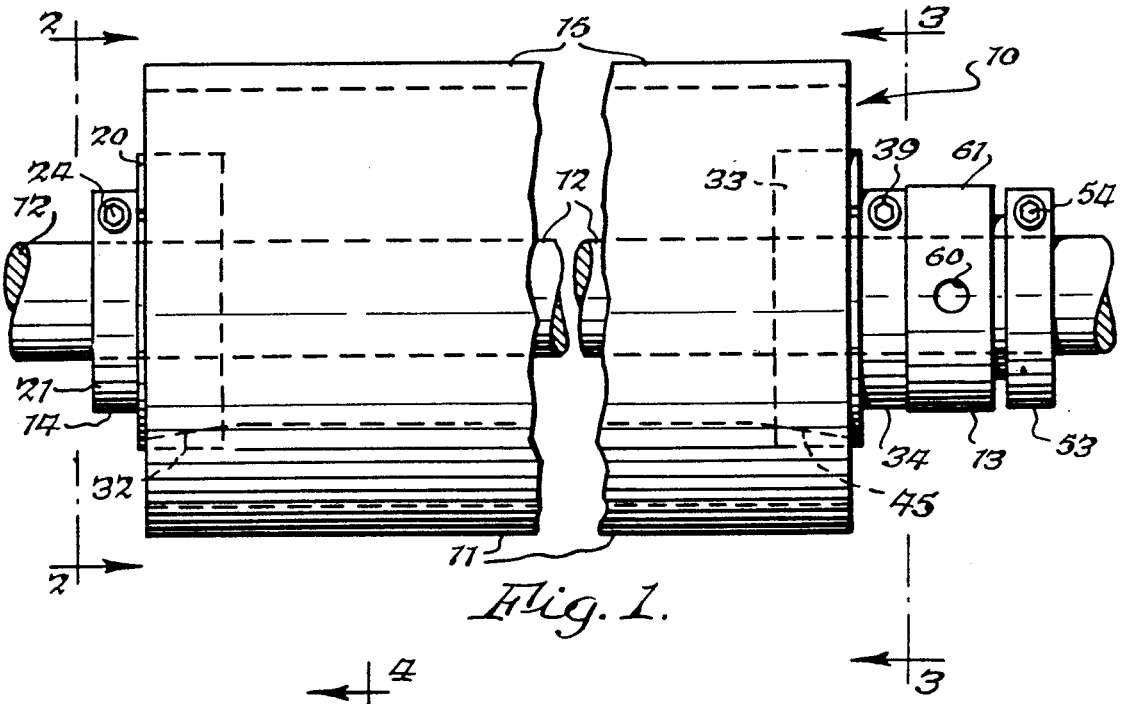
FIG. 1 is a fragmentary side elevational view of a printing cylinder mounted in position on the printing cylinder shaft.
Figure 2:
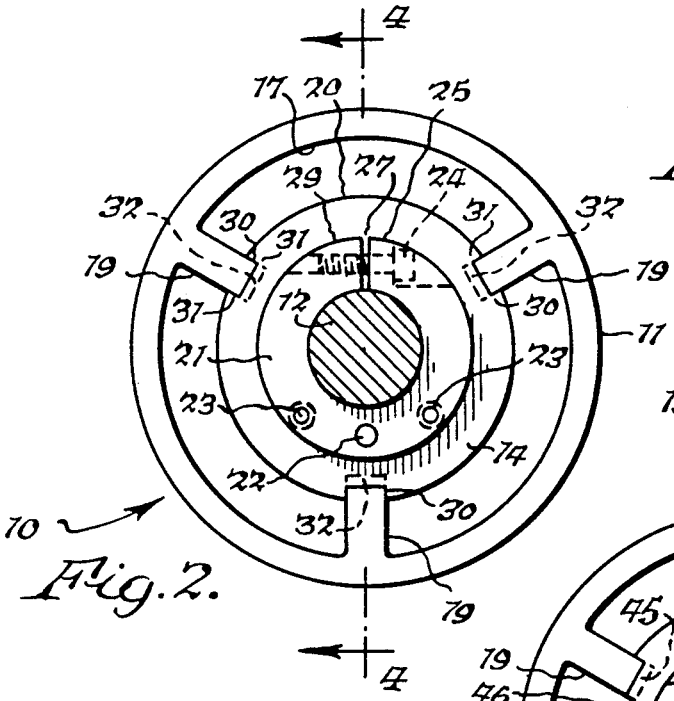
FIG. 2 is an end elevational view, partially in cross section, taken substantially along line 2—2 of FIG. 1 and showing the end of the printing cylinder in mounted position on the locating hub.

The printing cylinder mounting construction 10 of FIGS. 1–8 is for mounting printing cylinder 11 onto shaft 12 of a printing machine in an extremely quick, simple and efficient manner by merely slipping the printing cylinder 11 axially over the locking structure 13 on the right side of shaft 12 and onto the locating structure 14 at the left end of shaft 12 and thereafter manipulating the locking structure 13 to securely lock printing cylinder 11 in position. Printing cylinder 11 is cast polyurethane and has an external surface 15, an internal cylindrical surface 17 and a plurality of integral radial ribs 19 which extend inwardly from internal surface 17 and which extend axially of the cylinder for rigidizing it.

The locating structure 14 includes an annular polyurethane hub 20 and a clamp member 21 pinned thereto by pin 22. A plurality of screws 23 secure hub 20 to resilient annular metal clamp member 21. A screw 24 extends through the clamp portion 25 of the clamp member to the right of split 27 (FIG. 2) and is threadably received in a tapped bore in clamp portion 29. Clamp portions 25 and 29 are movable circumferentially toward and away from each other. Thus, when screw 24 is tightened, hub 20 is secured on shaft 12 against both axial and rotational movement. A plurality of circumferentially spaced slots 30 are located in hub 20, and each slot 30 has spaced parallel sides 31 extending substantially radially and an inclined side 32 therebetween (FIGS. 1 and 4).

The locking structure 13 includes an annular polyurethane hub 33 which is pinned to resilient annular metal clamp member 34 by pin 35 and secured thereto by screws 37. A screw 39 extends through clamp portion 40' on one side of split 41 and is threadably received in clamp portion 42. Clamp portions 40' and 42 are movable toward and away from each other. Thus, when screw 39 is tightened, annular hub 33 will be firmly secured to shaft 12. A plurality of deep slots 40 extend radially inwardly into hub 33. Slots 40 are sufficiently deep so that the innermost surfaces 41 (FIG. 4) of ribs 19 will clear surfaces 46 of slots 40. In other words, the innermost surfaces 41 of ribs 19 lie on a larger diameter than the innermost surfaces 46 of slots 40.

In order to mount printing cylinder 11 onto mounting structures 13 and 14, the screw 39 is loosened and hub 33 is rotated so that slots 40 thereof are in alignment with slots 30 of hub 20. Thereafter, the printing cylinder 11 is moved in the direction of arrow 36 in FIG. 7 until the inclined surfaces 43 at the ends of ribs 19 mate with inclined surfaces 32 of slots 30 (FIG. 4). At this time the innermost surfaces 41 of ribs 19 will have passed axially beyond inclined surfaces 50 of slot portions 45 which are adjacent to slots 40. Thereafter, hub 33 is rotated counterclockwise in FIG. 8 until the inclined end portions 44 of ribs 19 enter slot portions 45 of hub 33 and abut sides 47 (FIG. 6) of these slots. At this time inclined surfaces 49 (FIG. 4) at the ends of ribs 19 will lie in contiguous relationship with inclined surfaces 50 of slot portions 45. Thus slot portions 45 of hub 33 will now be in alignment with slots 30 of hub 20.

Figure 4:
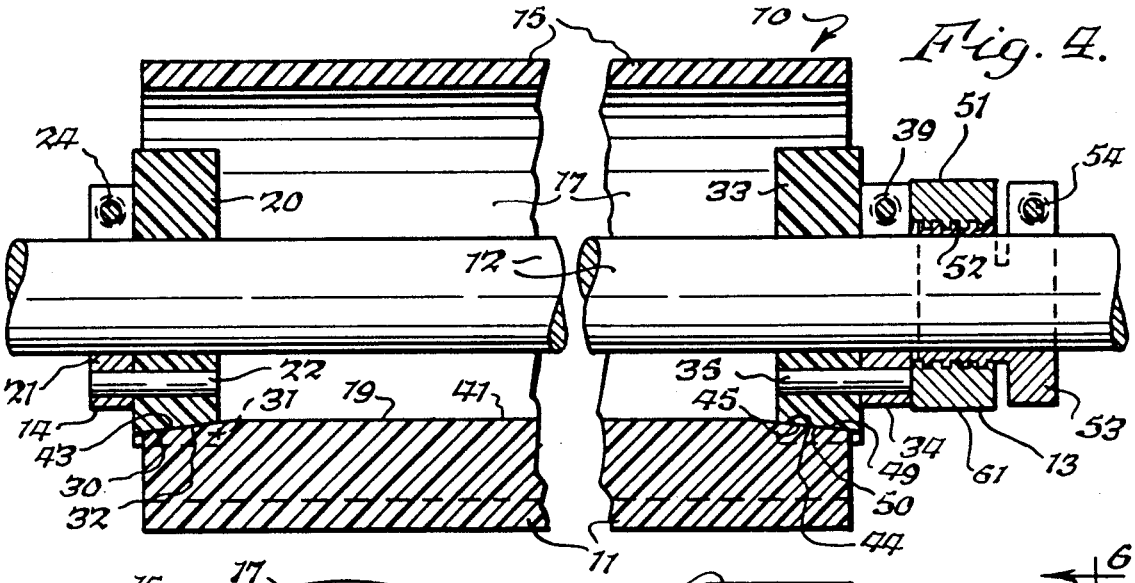
FIG. 4 is a fragmentary cross sectional view taken substantially along line 4—4 of FIG. 2 and showing the various assembled parts in greater detail.

The locking structure 13 also has structure for moving hub 33 to the left to the position of FIG. 4 to effect a wedging action between the inclined surfaces at the ends of ribs 19 and the inclined surfaces on the hubs 20 and 33. More specifically, a locking member 51 includes an inner annular threaded member 52 which has a resilient clamping member 53 formed at an outer end thereof (FIG. 4) to lock member 52 against axial and rotational movement on shaft 12. Resilient clamping member 53 is of identical structure to clamping members 21 and 34. More specifically, a screw 54 extends through clamp portion 55 and is threadably received in clamp portion 57 on the opposite side of split 59 from clamp portion 55. When screw 54 is tightened, threaded member 52 is firmly secured to shaft 12. A wrench-receiving opening 60 (FIG. 1) is located in rotatable member 61 which is threadably mounted on threaded portion 52. Thus, when member 61 is rotated, it will move axially to the left to the position of FIG. 4 and thus move hub 33 to the left when clamp member 34 is in a loosened condition, because of the abutting engagement between member 61 and clamp member 34. The foregoing axial movement is effected until there is a tight wedged relationship between ribs 19 and hubs 20 and 33. Thereafter, screw 39 of clamp member 34 is tightened to retain hub 33 in its final position shown in FIG. 4.

Figure 6:
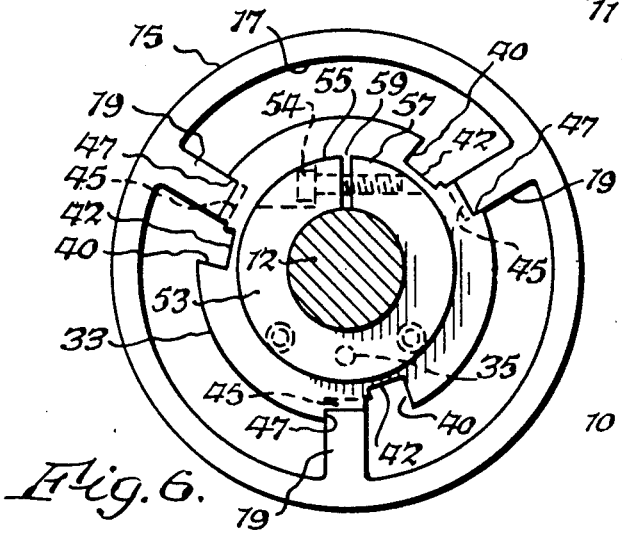
FIG. 6 is a cross sectional view showing the relative circumferential positions of the locking hub and the printing cylinder when they are in the positions of FIG. 5.
Figure 5:
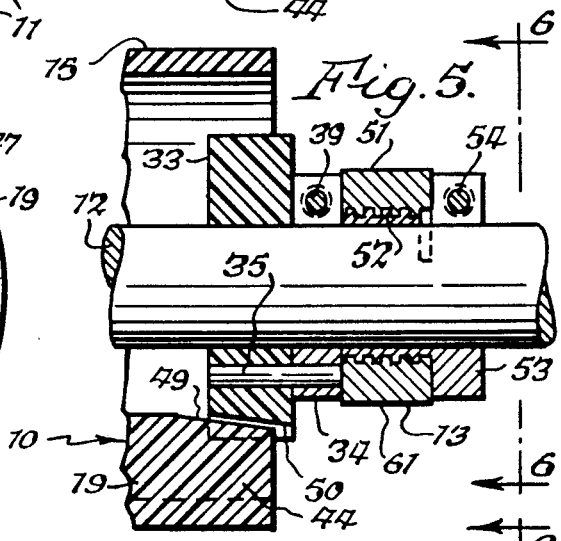
FIG. 5 is a fragmentary cross sectional view similar to FIG. 4 but showing the locking hub in an axially withdrawn position prior to being rotated for permitting the printing cylinder to be removed from its mounted position.
Figure 8:
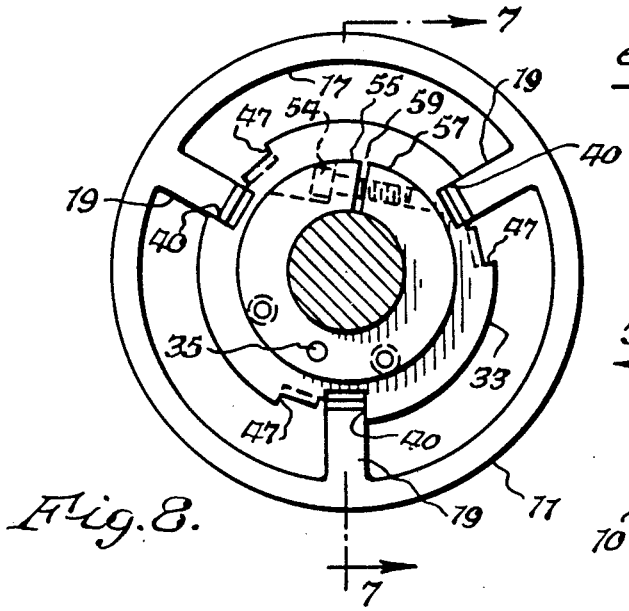
FIG. 8 is a cross sectional view taken substantially along line 8—8 of FIG. 7 and showing the relative circumferential positions between the locking hub and the printing cylinder when they are in the axial positions of FIG. 7.
Figure 7:
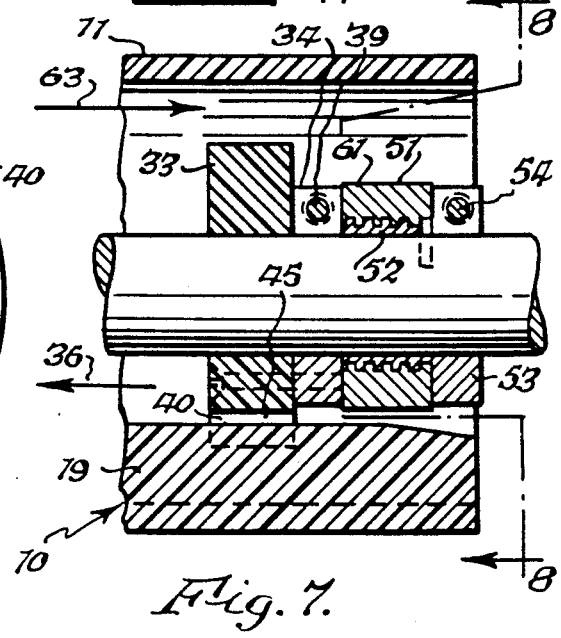
FIG. 7 is a fragmentary cross sectional view similar to FIG. 5 and taken substantially on line 7—7 of FIG. 8 but showing the relative positions between the locking hub and the printing cylinder after the locking hub has been rotated and the printing cylinder has been moved axially to the right in the direction of the arrow.

In order to demount printing cylinder 11 from its above-mentioned installed position shown in FIG. 6, a reverse procedure is followed. First of all, threaded member 61 is rotated to move it to the right in FIG. 4. Thereafter, screw 39 of clamp member 34 is loosened. Thereafter, hub 33 is rotated in a clockwise direction in FIG. 6 until ribs 19 are in alignment with deep slots 40. Thereafter, the printing cylinder 11 can be moved in the direction of arrow 63 of FIG. 7 to remove it from mounted position on hubs 20 and 33.

Figure 7A:
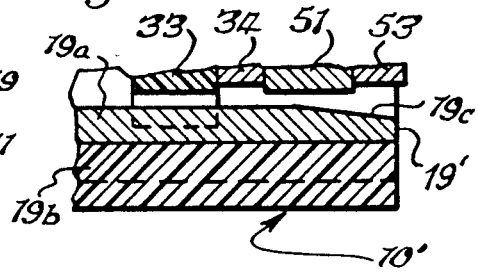
FIG. 7A is a fragmentary cross sectional view, similar to FIG. 7, and showing an alternate form of rib structure.
Figure 3:
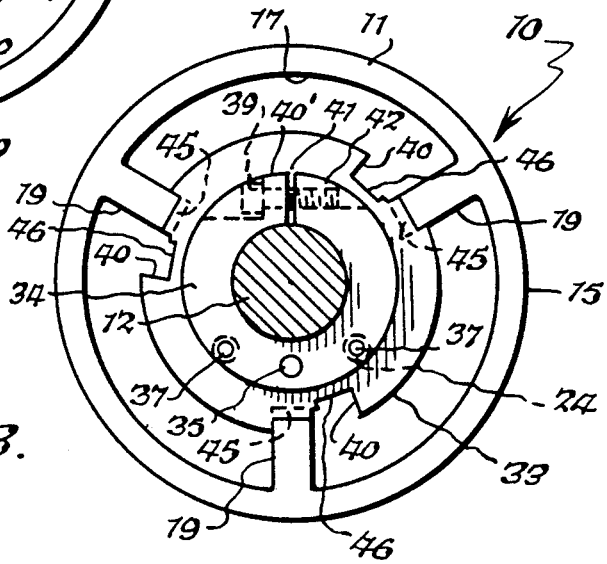
FIG. 3 is a cross sectional view taken substantially along line 3—3 of FIG. 1 and showing the printing cylinder in mounted position on the locking hub.

In FIG. 7A a modified form of rib is shown on a printing cylinder 10' which is identical to cylinder 10 except for the rib structure. Rib 19' is dimensionally the same as rib 19 except that it has a bar **19*a* of aluminum bonded to the underlying portion 19*b* of rib 19'. There are the same number of ribs 19' as ribs 19, and the innermost surfaces of bars 19*a* are of the same contour as the innermost surfaces of ribs 19, including inclined surfaces, such as 19*c*** at the opposite ends of the ribs.

It can thus be seen that the structure of FIGS. 1–8 is a quick mount-demount structure which does not require removal of either of the mounting structures 13 or 14 from the shaft, as was the case with previous designs. This enables a printing cylinder to be changed in a very short time, thereby saving approximately 15 minutes which was otherwise required for this task. In a printing machine, there are as many as twelve cylinders, and in the past, approximately 15 minutes was required to change each one. Thus, whenever twelve cylinders have to be changed, the present system does in fact save about three hours of down time on the machine. Furthermore, because hub 20 is fixedly positioned on shaft 12, once the printing cylinder has been properly mounted thereon, it is in perfect alignment. There is no need to rotate printing cylinder 11 for aligning it properly, as was the case with previous constructions. However, vernier adjustments may be provided on hub 20 to make minor adjustments if these are required. Thus, hub 20 not only constitutes a mounting hub but it also functions as a locating or alignment hub. Furthermore, it will readily be appreciated that different diameter printing cylinders can be mounted on the same size hubs by merely varying the radial dimensions of the ribs 19, that is, larger cylinders would have radially larger ribs which would lie on the same inner diameter as the smaller ribs of smaller cylinders.

In FIGS. 9–13 another embodiment of the present invention is disclosed. In this embodiment, the printing cylinder 70 can be slid on and off its associated hubs 71 and 72 without in any way removing them from shaft 73 on which they are mounted. Thus, in this respect, the embodiment of FIGS. 9–13 operates in the same manner as the embodiment of FIGS. 1–8. However, the specific locating or alignment structure 75 and locking structure 74 are different, as is the specific structure of printing cylinder 70 itself.

The printing cylinder 70 is fabricated out of polyurethane and it has an external surface 77 and an internal surface 79. A plurality of integral radial ribs 80 extend inwardly from inner surface 79 to rigidize the cylinder. The ends of ribs 80 are embedded in slots 81 (FIG. 10) of metal ring 82 at one end of cylinder 70, and the opposite ends of ribs 80 are embedded in slots 83 (FIG. 11) of metal ring 84. Actually the outer portion and ribs of printing cylinder 70 are cast polyurethane and the inner portions of the ribs are cast into the above-mentioned slots of rings 82 and 84 to provide a permanent assembly.

The locking structure 74 includes an annular hub 71 which has an annular resilient clamping ring 85 secured thereto by screws 87. A screw 89 extends through clamp portion 90 on the opposite side of split 91 from clamp portion 92 which threadably receives screw 89. Thus, when screw 89 is tightened, hub 71 is firmly mounted on shaft 73 against axial and circumferential displacement.

The locating structure 75 includes an annular hub 72 which is secured to annular resilient clamping ring 76 having portion 78 on one side of split 68 from portion 66 which threadably receives screw 86. Pin 72' locates hub 72 and clamping ring 76 relative to each other and they are secured by screws 73'. When clamping ring 76 is tightened, hub 72 will be locked in position on shaft 73. A plurality of circumferentially spaced keys 95 are embedded in hub 72.

A plurality of slots 93 (FIG. 12) are circumferenitally spaced in metal ring 84 which mounts on hub 71. As noted above, metal ring 84 is an integral portion of the printing cylinder. A plurality of slots 94 (FIG. 10) are circumferentially spaced in metal ring 82 which mounts on hub 72. Slots 93 and 94 of metal rings 84 and 82, respectively, are in alignment, as can be seen from a comparison of FIGS. 10 and 12. A plurality of keys 95 (FIGS. 9 and 10) are located in locating hub 72 and are spaced circumferentially the same amount as aligned slots 93 and 94 in rings 84 and 82, respectively. Thus, printing cylinder 70 can be slid from right to left in FIG. 9 because slots 93 in ring 84 will slide over keys 95 in hub 72 and thereafter slots 94 will ride onto keys 95 of ring 82. Keys 95 thus circumferentially align cylinder 70 relative to shaft 73.

Figure 9:
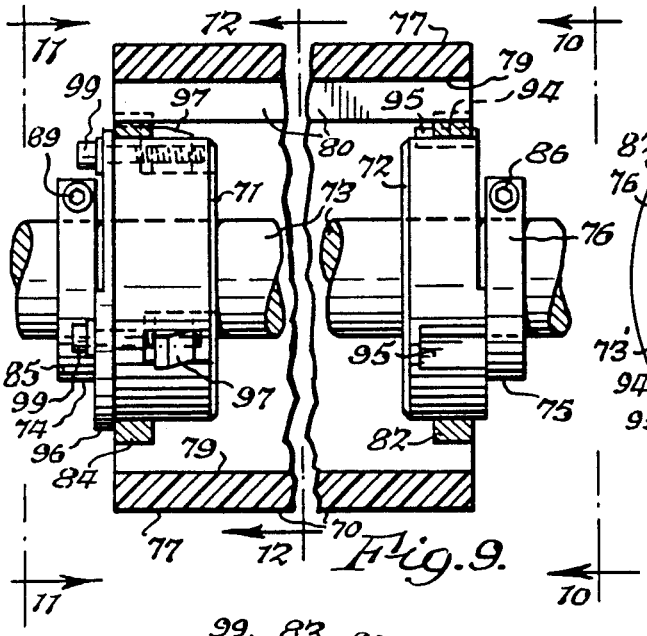
FIG. 9 is a fragmentary cross sectional view taken substantially along line 9—9 of FIG. 10 and showing an alternate embodiment of the present invention.
Figure 10:
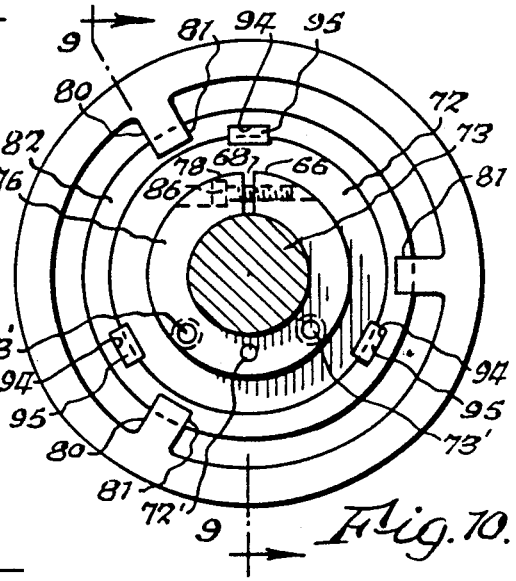
FIG. 10 is a cross sectional view taken substantially along line 10—10 of FIG. 9 and showing the locating structure at one end of the printing cylinder.
Figure 11:
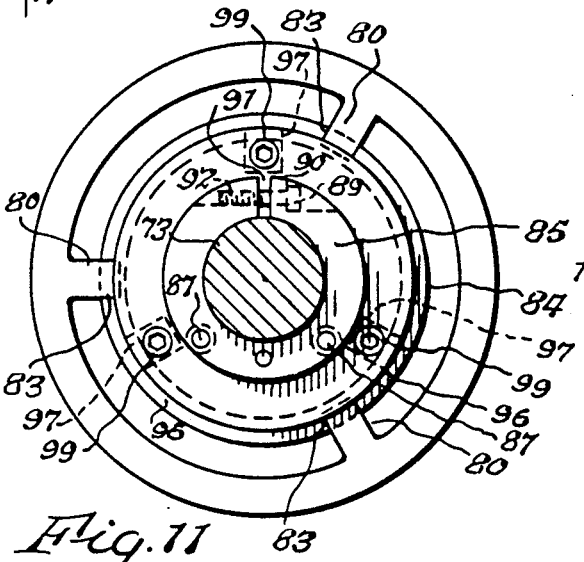
FIG. 11 is a cross sectional view taken substantially along line 11—11 of FIG. 9 and showing the locking structure in an unlocking position at the other end of the printing cylinder.
Figure 12:
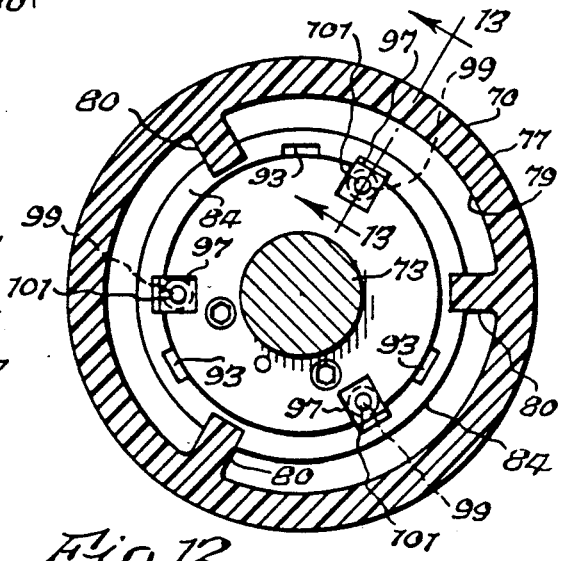
FIG. 12 is a cross sectional view taken substantially along line 12—12 of FIG. 9 and showing the locking structure rotated to a locking position from the unlocking position of FIG. 11.
Figure 13:
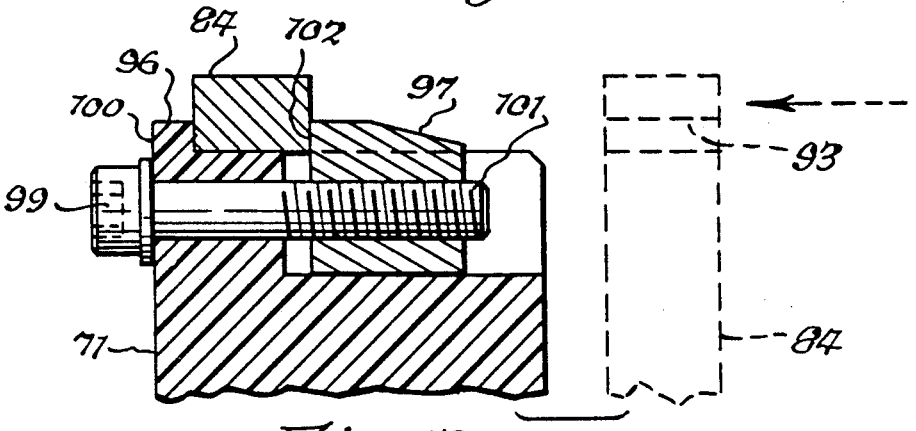
FIG. 13 is an enlarged fragmentary cross sectional view taken substantially along line 13—13 of FIG. 12 and showing the structure of the locking gib and showing, in dotted lines, the relationship of the metal ring on the cylinder thereto.

During the process of sliding of printing cylinder 70 to the left, gibs 97 mounted on hub 71 will be in the positions of FIGS. 9 and 11, and they will be aligned with keys 95 of hub 72, and thus metal ring 84 will be able to move to the left past gibs 97 to the position of FIG. 9. After the printing cylinder 70 has reached the position shown in FIG. 9 wherein the left edge of ring 84 abuts annular rim 96 of hub 71, screw 89 is caused to be sufficiently loose so that clamp 85 and hub 71 attached thereto can be rotated either in a clockwise direction to the position of FIG. 12 or in a counterclockwise direction so that gibs 97 are no longer in alignment with slots 94 in ring 82. At this time, gibs 97 must be spaced sufficiently from rim 96 to permit the foregoing rotation. Screw 89 of clamp 85 is then tightened to lock hub 71 after gibs 97 are out of alignment with slots 93 of ring 84, as shown in FIG. 12. Thereafter, screws 99, which extend through flange 100 on hub 71 and are threadably received in bores 101 (FIG. 13) of gibs 97, are tightened to cause shoulders 102 of gibs 97 to bear against metal ring 84 to thereby clamp the metal ring between them and rim 96 to lock printing cylinder 70 in position. It will be appreciated that rim 96 must be axially aligned on shaft 73 so that cylinder 70 is in proper axial alignment. To this end, a proper calibration can be provided on shaft 73.

Thus, the keys 95 on hub 72 properly align printing cylinder 70 circumferentially relative to shaft 73 but do not have any function in preventing axial motion of printing cylinder 70. The gibs 97 serve only to lock printing cylinder 70 in position but they do not have any locating function, but rim 96 aligns the cylinder axially on shaft 73.

When it is desired to remove printing cylinder 70 from its above-described installed position, it is merely necessary to loosen gib screws 99 to move gibs 97 away from metal ring 84, loosen clamping screw 89, and thereafter rotate clamping ring 85 and hub 71 from the position of FIG. 12 to the position of FIGS. 9 and 11 where gibs 97 are aligned with slots 93 in ring 84. Thereafter, it is only necessary to move printing cylinder 70 to the right in FIG. 9 so that slots 93 will pass over gibs 97 and thereafter pass over keys 95 when it reaches hub 72.

It can thus be seen that the embodiment of FIGS. 9–13 also permits mounting and demounting of a printing cylinder onto a shaft of a printing machine without the necessity of removing the associated hubs from the shaft. Also, as with the embodiment of FIGS. 1–8 different diameters of printing cylinders may be mounted on the same size hubs. In this respect, it is only necessary that rings, such as 82 and 84, remain the same for all sizes, and the only differences are the radial lengths of the ribs, that is, larger cylinders will have radially larger ribs and vice cersa.

While the printing cylinders have been shown as cast polyurethane, it will be appreciated that any other plastics which have suitable characteristics can be used.

While preferred embodiments of the present invention have been disclosed, it will be appreciated that it is not limited thereto but may be otherwise embodied within the scope of the following claims.

What is claimed is:

1. A mounting construction for a printing cylinder comprising a shaft, a first hub on said shaft, a second hub on said shaft axially spaced from said first hub, said first and second hubs being of larger diameter than said shaft, and elongated hollow printing cylinder having first and second internal end portions for mounting on said first and second spaced hubs, respectively, first coacting means located between said second internal end portion and said first hub for permitting said second internal end portion to pass axially over said first hub until said second internal end portion is proximate said second hub and said first internal end portion is proximate said first hub, means for effecting rotation of one of said first and second hubs relative to said shaft after said first and second internal end portions are proximate said first and second hubs, respectively, second coacting means between one of said first and second hubs and one of said first and second internal end portions, respectively, for locking said hollow printing cylinder thereon, and third coacting means on the other of said first and second hubs and the other of said first and second internal end portions for mounting said hollow printing cylinder thereon.

2. A mounting construction for a printing cylinder as set forth in claim 1 wherein said second and third coacting means comprise first and second rings, respectively, first and second slot means in said first and second rings, respectively, and wherein said first coacting means include said second slot means in said second ring and first key means on said first hub over which said second slot means in said second ring pass until said first key means are received in said first slot means, and wherein said second coacting means also comprise shoulder means on said second hub, gib means on said second hub for passing through said second slot means until said second ring abuts said shoulder means, and wherein said means for effecting rotation of said second hub moves said gib means out of alignment with said second slot means after said second ring has moved proximate said shoulder means, and means for clamping said second ring between said gib means and said shoulder means, and wherein said third coacting means comprise interengaging surfaces on said first ring and said first hub.

3. A mounting construction for a printing cylinder as set forth in claim 2 including a plurality of internal ribs extending longitudinally in said hollow cylinder, and wherein said first and second rings are mounted on said internal ribs.

4. A mounting construction for a printing cylinder as set forth in claim 1 wherein said second and third coacting means comprise first and second rings respectively, slot means in said second ring, and wherein said second coacting means comprise shoulder means on said second hub, gib means on said second hub for passing through said slot means until said second ring abuts said shoulder means, and wherein said means for effecting rotation of said one of said first and second hubs effects rotation of said second hub to move said gib means out of alignment with said slot means after said second ring has moved proximate said shoulder means, and means for clamping said second ring between said gib means and said shoulder means, and wherein said third coacting means comprise interengaging surfaces on said first ring and said first hub.

5. A mounting construction for a printing cylinder comprising a shaft, first and second spaced hubs on said shaft, said first and second spaced hubs being of a larger diameter than said shaft, first slot means on at least one of said first and second hubs, respectively, a hollow printing cylinder having external and internal surfaces and a longitudinal axis, rib means extending radially inwardly from said internal surface, end portion means on said rib means, first inclined surface means on at least one of said end portion means, second inclined surface means on said first slot means on said at least one of said first and second hubs for mating engagement with said first inclined surface means, respectively, second slot means in said one of said first and second hubs, said second slot means being of a dimension to permit said rib means to pass therethrough as said printing cylinder moves axially of said shaft to receive said first and second hubs, means for rotating said one of said first and second hubs having said second slot means relative to said shaft for placing said first and second inclined surfaces in alignment after said rib means have passed through said second slot means, and locking means on said one of said first and second hubs for securing said hollow printing cylinder relative to said first and second hubs after said printing cylinder is mounted thereon.

6. A mounting construction for a printing cylinder comprising a shaft, first and second spaced hubs on said shaft, first mounting means for mounting said first hub on said shaft, a plurality of first circumferentially spaced slots on said first hub having first inclined circumferential surfaces converging toward said second hub, a plurality of second circumferentially spaced slots on said second hub and having second inclined circumferential surfaces converging toward said first hub, a hollow printing cylinder having an outer surface and an inner surface, a plurality of ribs extending longitudinally of said cylinder and extending radially inwardly from said internal surface, inclined end portions on certain of said ribs of substantially the same inclination as said inclined circumferential surfaces on said hubs for mating engagement therewith, a plurality of third slots in said second hub circumferentially spaced from said second slots and being of a sufficient depth to permit said ribs to pass therethrough, second mounting means for rotatably mounting said second hub on said shaft to effect alignment between inclined circumferential surfaces and said second inclined end portions, and means for moving said second hub axially on said shaft after said alignment has been effected to thereby wedge said cylinder between said first and second hubs.

7. A mounting construction for a printing cylinder as set forth in claim 6 wherein said inclined circumferential surfaces are in both of said first and second slots, and wherein said inclined end portions are on both ends of said ribs.

8. A mounting construction for a printing cylinder as set forth in claim 6 wherein said printing cylinder is fabricated entirely of polyurethane.

9. A mounting construction for a printing cylinder comprising a shaft, first and second spaced hubs on said shaft, said shaft being of a first diameter between said hubs, and said hubs being of a second diameter which is larger than said first diameter of said shaft between said hubs, a hollow printing cylinder having an external surface and an internal surface, a plurality of circumferentially spaced ribs extending inwardly from said internal surface, said spaced ribs having an inner diameter throughout their lengths which is larger than the outer diameter of all parts of said shaft between said first and second hubs and said ribs being spaced radially outwardly from said shaft between said hubs, coacting means on one of said hubs and on said ribs for permitting said ribs to move axially over said one hub and onto the other of said hubs, and means on at least one of said two hubs for locking said printing cylinder thereto.

10. A mounting construction for a printing cylinder as set forth in claim 9 wherein said coacting means comprises a gib on said one hub and a member which is located between said ribs.

11. A mounting construction for a printing cylinder as set forth in claim 10 wherein said member is a ring which is mounted on said ribs.

12. A mounting construction for a printing cylinder as set forth in claim 9 wherein said locking means is on said one hub.

13 A mounting construction for a printing cylinder as set forth in claim 9 wherein said locking means is on the other of said hubs.

14. A mounting construction for a printing cylinder comprising a shaft, a first hub on said shaft, a second hub on said shaft axially spaced from said first hub, an elongated hollow printing cylinder having first and second internal end portions, first coacting means between said second internal end portion and said first hub for permitting said second internal end portion to pass axially over said first hub until said second internal end portion is proximate said second hub and said first internal end portion is proximate said first hub, second coacting means between one of said first and second hubs and one of said first and second internal end portions, respectively, for locking said hollow printing cylinder relative thereto, third coacting means on the other of said first and second hubs and the other of said first and second internal end portions for mounting said hollow printing cylinder thereon, a plurality of internal ribs extending longitudinally in said hollow cylinder, first and second end portions on said internal ribs, said first coacting means comprising first slot means in said first hub for permitting said internal ribs to pass therethrough, said second coacting means comprising second slot means in said first hub of lesser depth than said first slot means and circumferentially spaced from said first slot means, said third coacting means comprising first mating inclined surfaces between said second end portions on said internal ribs and said second hub, said second coacting means comprising second mating inclined surfaces between said first end portions on said internal ribs and said second slot means on said first hub, and means for axially moving said first hub to effect wedging engagement between said first mating inclined surfaces and between said second mating inclined surfaces.

15. A mounting construction for a printing cylinder comprising a shaft, first and second spaced hubs on said shaft said first and second spaced hubs being of a larger diameter than said shaft, first and second slot means on said first and second hubs, respectively, a hollow printing cylinder having external and internal surfaces and a longitudinal axis, rib means extending radially inwardly from said internal surface, first and second end portion means on said rib means, first and second inclined surface means on said first and second end portion means, respectively, first and second inclined surface means on said first and second hubs, respectively, in said first and second slot means, respectively, third slot means in one of said first and second hubs, said third slot means being of a dimension to permit said rib means to pass therethrough as said printing cylinder moves axially of said shaft to receive said first and second hubs, means for rotating said one of said first and second hubs having said third slot means relative to said shaft for placing said first and second inclined surface means on said first and second hubs in alignment with each other and with said first and second inclined end portions, respectively, after said rib means have passed through said third slot means, and locking means on said one of said first and second hubs for securing said hollow printing cylinder relative to said first and second hubs after said printing cylinder is mounted thereon.

* * * * *

UNITED STATES PATENT AND TRADEMARK OFFICE

CERTIFICATE OF CORRECTION

PATENT NO. : 5,036,766

DATED : August 6, 1991

INVENTOR(S) : Richard F. Songer

It is certified that error appears in the above-identified patent and that said Letters Patent is hereby corrected as shown below:

Column 6, line 44, change "vice cersa" to --vice versa--.

Column 8, line 26 (claim 6), before "inclined" insert --said second--;

line 27 (claim 6), cancel "second".

Signed and Sealed this

Twenty-fourth Day of November, 1992

*Attest:*

DOUGLAS B. COMER

*Attesting Officer*

*Acting Commissioner of Patents and Trademarks*